US006695749B2

(12) United States Patent
Kuo

(10) Patent No.: US 6,695,749 B2
(45) Date of Patent: Feb. 24, 2004

(54) EXERCISER HAVING LATERALLY MOVABLE FOOT SUPPORT

(76) Inventor: Hai Pin Kuo, No. 15, Lane 833, Wen Hsien Road, Tainan 704 (TW)

( * ) Notice: Subject to any disclaimer, the term of this patent is extended or adjusted under 35 U.S.C. 154(b) by 54 days.

(21) Appl. No.: 10/151,206

(22) Filed: May 16, 2002

(65) Prior Publication Data

US 2003/0216222 A1 Nov. 20, 2003

(51) Int. Cl.[7] ..... A63B 22/04
(52) U.S. Cl. ..... 482/53; 482/71
(58) Field of Search ..... 482/51–53, 57, 482/70, 71–72, 110, 112

(56) References Cited

U.S. PATENT DOCUMENTS 5,238,462 A * 8/1993 Cinke et al. ..... 482/52
5,299,993 A * 4/1994 Habing ..... 482/52
5,308,300 A * 5/1994 Chino et al. ..... 482/52
5,595,554 A * 1/1997 Maresh ..... 482/52
5,645,512 A * 7/1997 Yu ..... 482/53

* cited by examiner

*Primary Examiner*—Stephen R. Crow
(74) *Attorney, Agent, or Firm*—Charles E. Baxley

(57) ABSTRACT

An exerciser includes two foot supports pivotally secured to a base with a pivot shaft, and movable up and down relative to the base about the pivot shaft for conducting stepping exercises. Two casings are rotatably supported on the base and coupled to the foot supports with actuators. A pole is rotatably supported on the base and has two screws, two rotary members are threaded with the screws and coupled to the casings for rotating the casings relative to the base and for moving the foot supports laterally when the rotary members are moved along the pole by the screws.

19 Claims, 13 Drawing Sheets

EXERCISER HAVING LATERALLY MOVABLE FOOT SUPPORT

BACKGROUND OF THE INVENTION

1. Field of the Invention

The present invention relates to an exerciser, and more particularly to an exerciser having laterally movable foot supports.

2. Description of the Prior Art

Typical exercisers, particularly the stepping exercisers, as shown in FIGS. 15, 16, comprise a pair of foot supports or blocks 91 pivotally secured to a base with a pivot shaft 93 and an arm 96, each for supporting a foot pedal 92 thereon respectively, for allowing the foot supports 91, 92 to be rotated about the pivot shaft 93, and to be moved up and down relative to the supporting surface or the ground 94 by the arms 96. However, as best shown in FIG. 16, the foot supports 91, 92 may only be moved up and down relative to the supporting surface or the ground 94, and may not be moved sidewise or laterally relative to the base of the exerciser or the ground.

The present invention has arisen to mitigate and/or obviate the afore-described disadvantages of the conventional exercisers.

SUMMARY OF THE INVENTION

The primary objective of the present invention is to provide an exerciser including a pair of foot supports that may be moved laterally or sidewise relative to the base.

In accordance with one aspect of the invention, there is provided an exerciser comprising a base, a pair of foot supports pivotally secured to the base with a pivot shaft, and movable up and down relative to the base about the pivot shaft for conducting stepping exercises, and means for moving the foot supports laterally relative to the base.

The moving means includes a pair of casings rotatably supported on the base, and means for coupling the casings to the foot supports.

The coupling means includes a pair of resisting members coupled between the casings and the foot supports respectively. The base includes a housing secured thereon.

A device may further be provided for rotating the casings relative to the base, and includes a pole rotatably supported on the housing and having two screws, two rotary members threaded with the screws respectively, and means for connecting the rotary members to the casings, the casings are rotated relative to the base when the rotary members are moved relative to the pole and when the pole is rotated relative to the housing.

The connecting means includes a pair of arms extended from the casings, and coupled to the rotary members with links respectively.

A device may further be provided for rotating the pole relative to the housing, and includes a motor secured to the housing, and coupled to the pole for driving the pole.

The housing includes a pair of studs extended therefrom. A device may further be provided for guiding the casings to rotate relative to the housing, and includes a panel secured to each of the casings, the panels each includes a curved channels formed therein for slidably receiving the studs of the housing, and for guiding the casings to rotate relative to the housing.

A device may further be provided for pivotally securing the foot supports to the pivot shaft, and includes at least two flaps secured to the pivot shaft, the foot supports each includes at least one beam having a first end pivotally secured to the at least two flaps with pivot pins, for allowing the foot supports to be rotated relative to the pivot shaft about the pivot pins.

The foot supports each includes a coupler pivotally secured to a second end of the beam, and a foot pedal pivotally secured to the coupler with a pivot rod. A pair of levers may be pivotally coupled between the flaps and the couplers.

A device may further be provided for applying a resistive force against the foot supports and includes a first wheel rotatably supported on the base with a pivot axle, and means for coupling the first wheel to the foot supports.

The coupling means includes a pinion secured to the pivot axle, a belt engaged over the pinion and having a first end secured to the foot support and having a second end, and a resilient cable coupled between the second end of the belt and the base.

A second wheel may further be provided and rotatably supported on the base, and means for connecting the second wheel to the first wheel. A device may be used for braking the second wheel.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
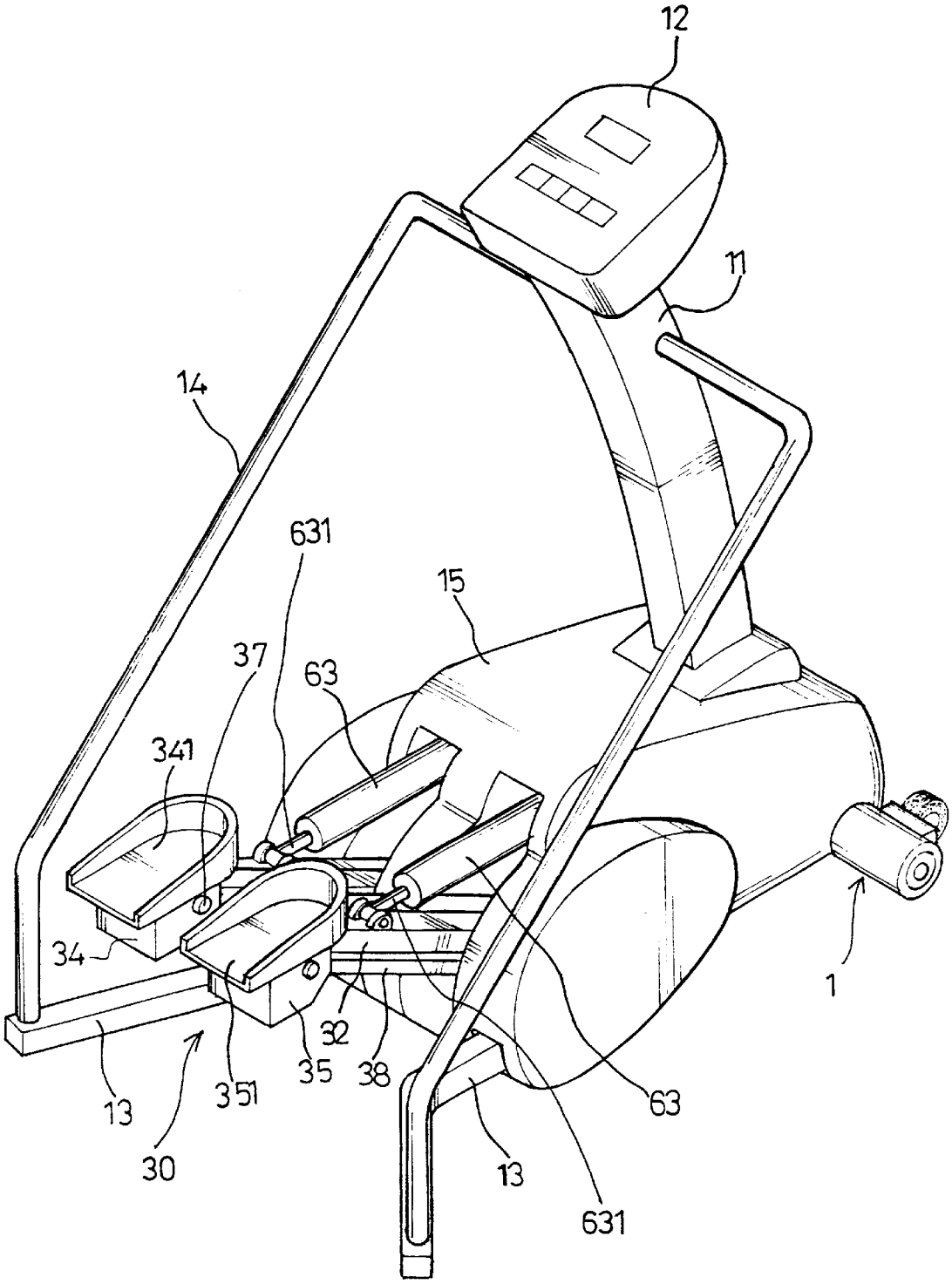
FIG. 1 is a perspective view of an exerciser in accordance with the present invention.
Figure 2:
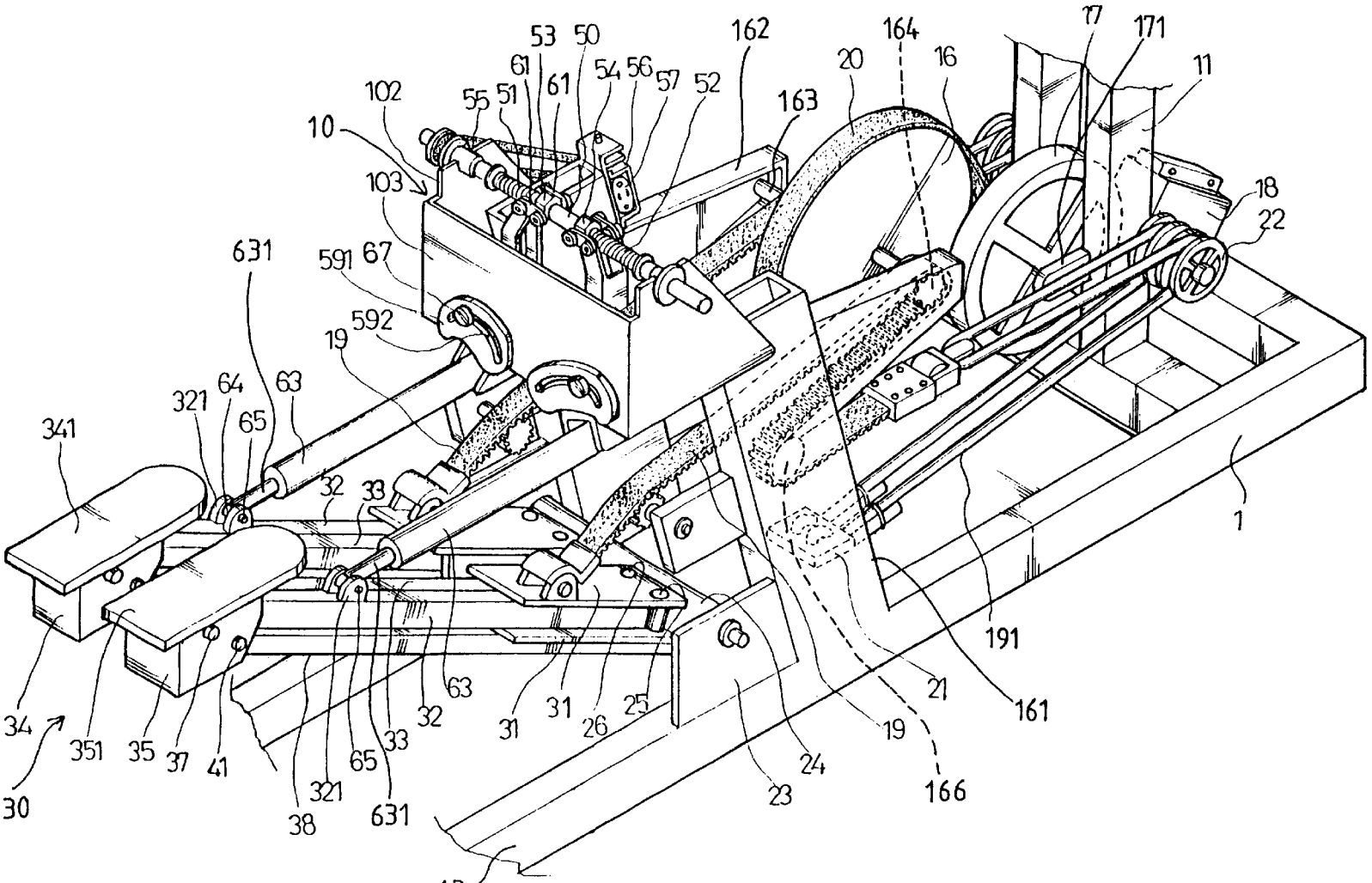
FIG. 2 is an enlarged partial perspective view of the exerciser.

Referring to the drawings, and initially to FIGS. 1–5, an exerciser in accordance with the present invention comprises a base 1 including a post 11 extended upward from the front portion thereof, and a displayer device or a control panel 12 provided on top of the post 11. A handle 14 may be coupled between the upper portion of the post 11 and the rear portion 13 of the base 1 for supporting the upper portion of the users. A cover 15 may be provided and secured on the upper portion of the base 1 for shielding or covering the members or the elements of the exerciser.

A wheel 16 is rotatably supported on the base 1, with such as one or more columns 161 and one or more extensions 162, and with a pivot axle 163. Two pinions 164 are secured to the pivot axle 163 and rotated in concert with the pivot axle 163. A weight or another wheel 17 is rotatably supported on the base 1, with such as one or more limbs 171 (FIG. 2) that may be extended from the base 1 or the post 11, and with a pivot spindle 173. A belt 20 is coupled between the wheel 16 and the pivot spindle 173, for coupling the wheels 16, 17 together.

Similarly, the wheels 16, 17 may be rotatably coupled together with the other coupling mechanisms, such as the sprockets-and-chain coupling mechanisms (not shown), the gearing mechanisms (not shown) or the like, which are typical and will not be described in further details. A typical brake device 18, such as a magnetic braking device or a disc braking device may be provided for braking the wheels 16, 17, such as the wheel 17, and for providing a resistive force against the wheels 16, 17 or the exerciser.

A pair of foot supports 30 are rotatably or pivotally secured to the base 1, such as secured to the side ears 23 of the base 1 with a pivot shaft 24. For example, the foot supports 30 each includes a pair of flaps 31 secured to the shaft 24 and rotated in concert with the shaft 24, and each includes a pair of beams 32, 33 having one end pivotally or rotatably secured to or between the flaps 31 with pivot pins 25, 26 which are preferably perpendicular to the shaft 24, for allowing the beams 32, 33 to be rotated sidewise or laterally relative to the flaps 31. The flaps 31 and the beams 32, 33 may be rotated up and down relative to the base 1 about the shaft 24, and the beams 32, 33 may be rotated relative to the flaps 31 about the pins 25, 26.

The foot supports 30 each includes a coupler 36 pivotally or rotatably secured to the other ends of the beams 32, 33 with pivot pins 27, 28, such that the two pairs of beams 32, 33 may be stably and pivotally or rotatably coupled between the couplers 36 and the flaps 31 respectively. The foot supports 30 further include a pair of foot pedals 34, 35 rotatably secured to the couplers 26 with pivot rods 37 respectively, the foot pedals 34, 35 each includes a plate or a pad or a cushion 341, 351 provided on top thereof for supporting the users. The foot pedals 34, 35 may be rotated relative to the beams 32, 33 about the pins 27, 28, and may also be rotated relative to the couplers 36 about the pivot rods 37.

A pair of brackets 101 are rotatably secured to the base 1 with a pivot spindle 39 (FIGS. 3, 4) which is parallel to the shaft 24. The foot supports 30 each further includes a lever 38 arranged parallel to the beams 32, 33 and having one end pivotally or rotatably secured to the brackets 101 with a pivot pin 29 for allowing the levers 38 to be rotated sidewise or laterally relative to the brackets 101. The brackets 101 and the levers 38 may be rotated up and down relative to the base 1 about the pivot spindle 39. The levers 38 each has one end rotatably or pivotally secured to the foot supports 34, 35 with a universal joint 40 and/or a pin 41. For example, the universal joint 40 is secured in the pin 41 for rotatably or pivotally receiving the one end of the levers 38.

As shown in FIGS. 2–5, 11, 13 and 14, the foot pedals 34, 35 of the foot supports 30 may thus be rotated or moved up and down relative to the base 1 about the shaft 24, and may be moved or rotated sidewise or laterally relative to the flaps 31 and the shaft 24 and the base 1, such that the foot supports 30 may be moved sidewise or laterally relative to the base 1 in addition to the up and down movement relative to the base 1.

One or more, such as two pinions 166 are further provided and secured to the columns 161 respectively. One or more, such as two belts 19 are engaged over the pinions 164, 166, and each has one end secured to the foot supports 30, such as the flaps 31 of the foot supports 30 respectively, and the other end coupled to one or more resilient cables 191 respectively. The resilient cables 191 are engaged over one or more wheels or pulleys 22, and have one end secured to the other ends of the belts 19, and the other end secured to the base 1 or to the columns 161 with fasteners 21 or the like.

Figure 3:
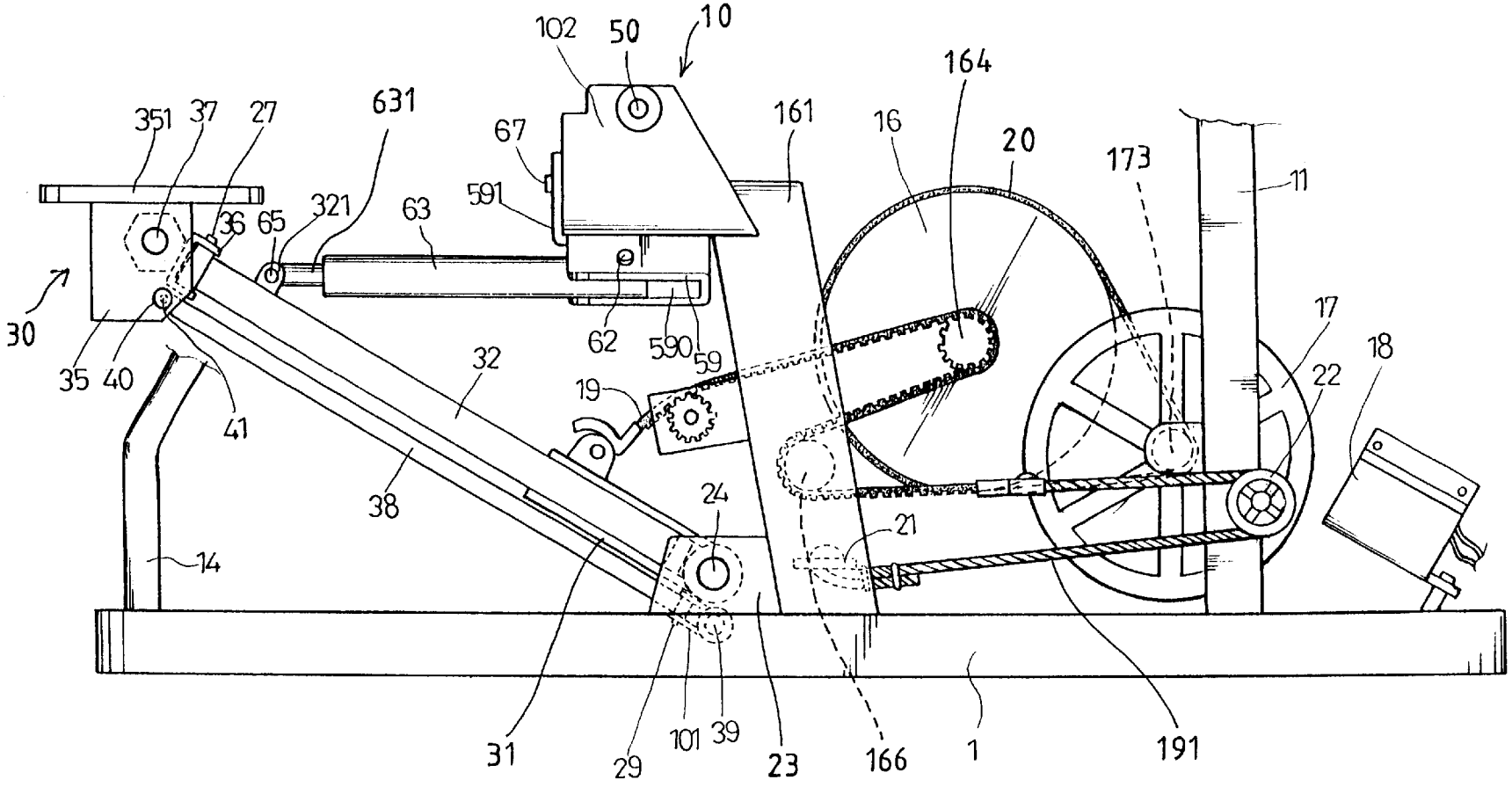
FIG. 3 is a partial side view, such as the right side view of the exerciser.
Figure 4:
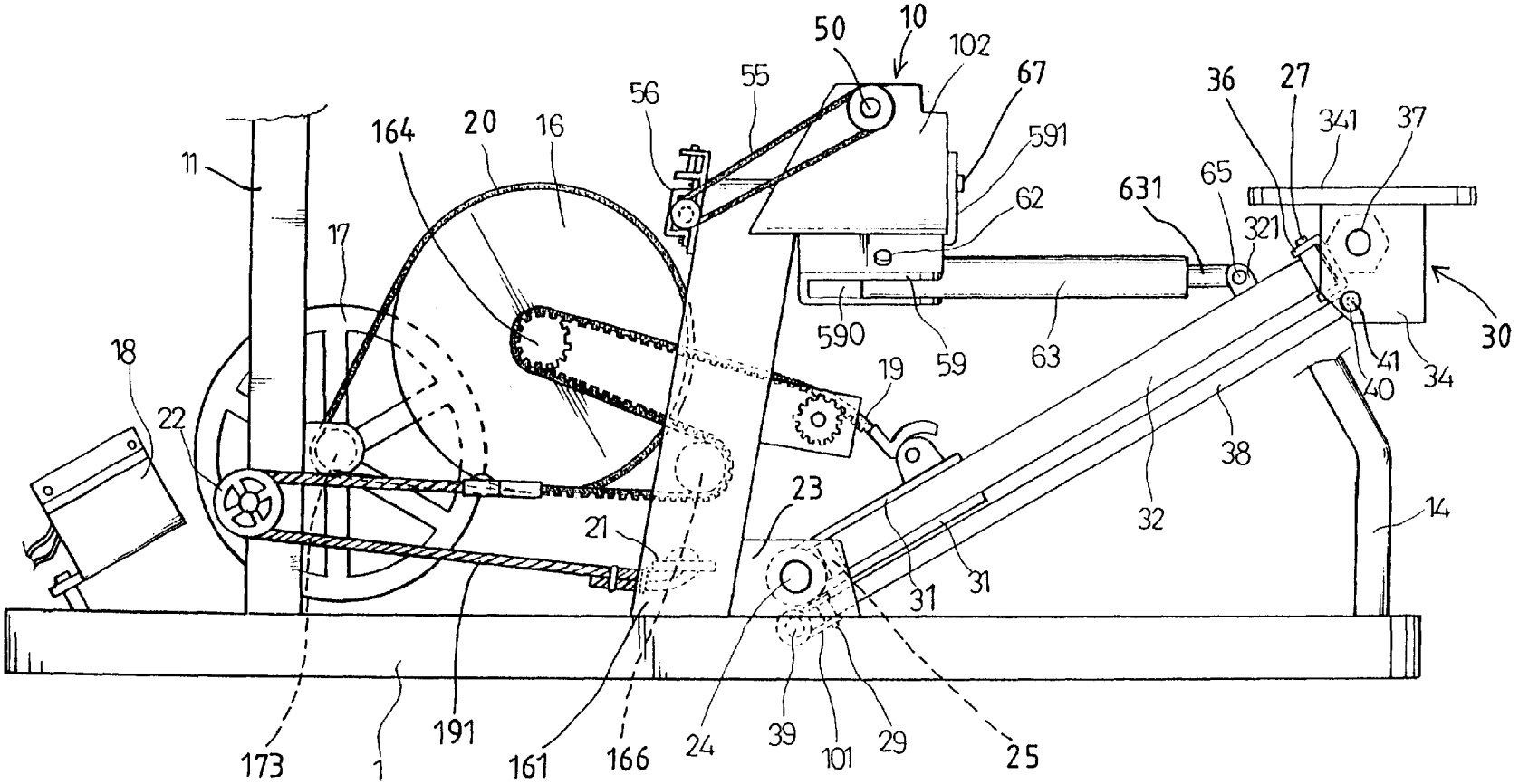
FIG. 4 is a partial side view, such as the left side view of the exerciser.
Figure 5:
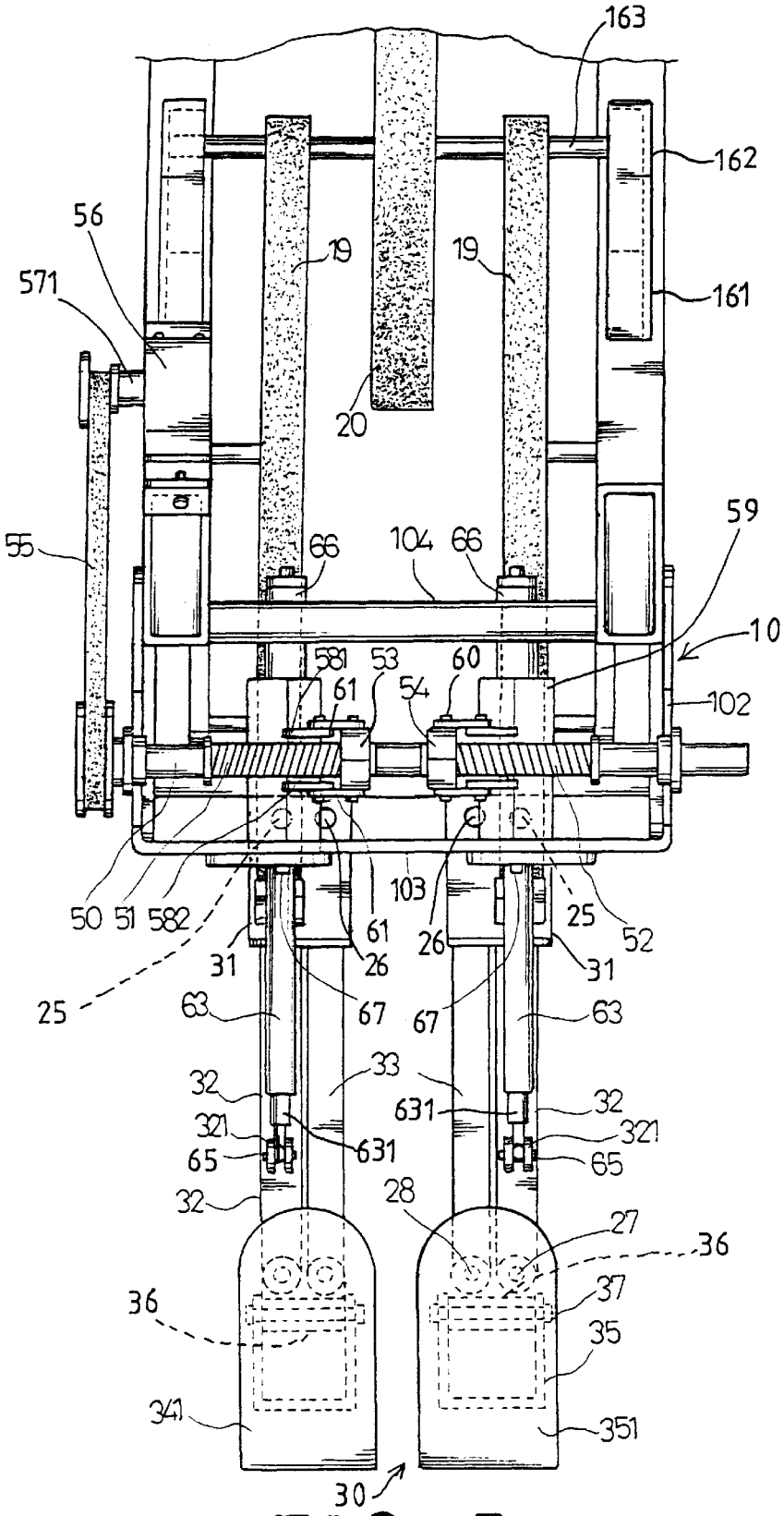
FIG. 5 is a partial top plan view of the exerciser.
Figure 12:
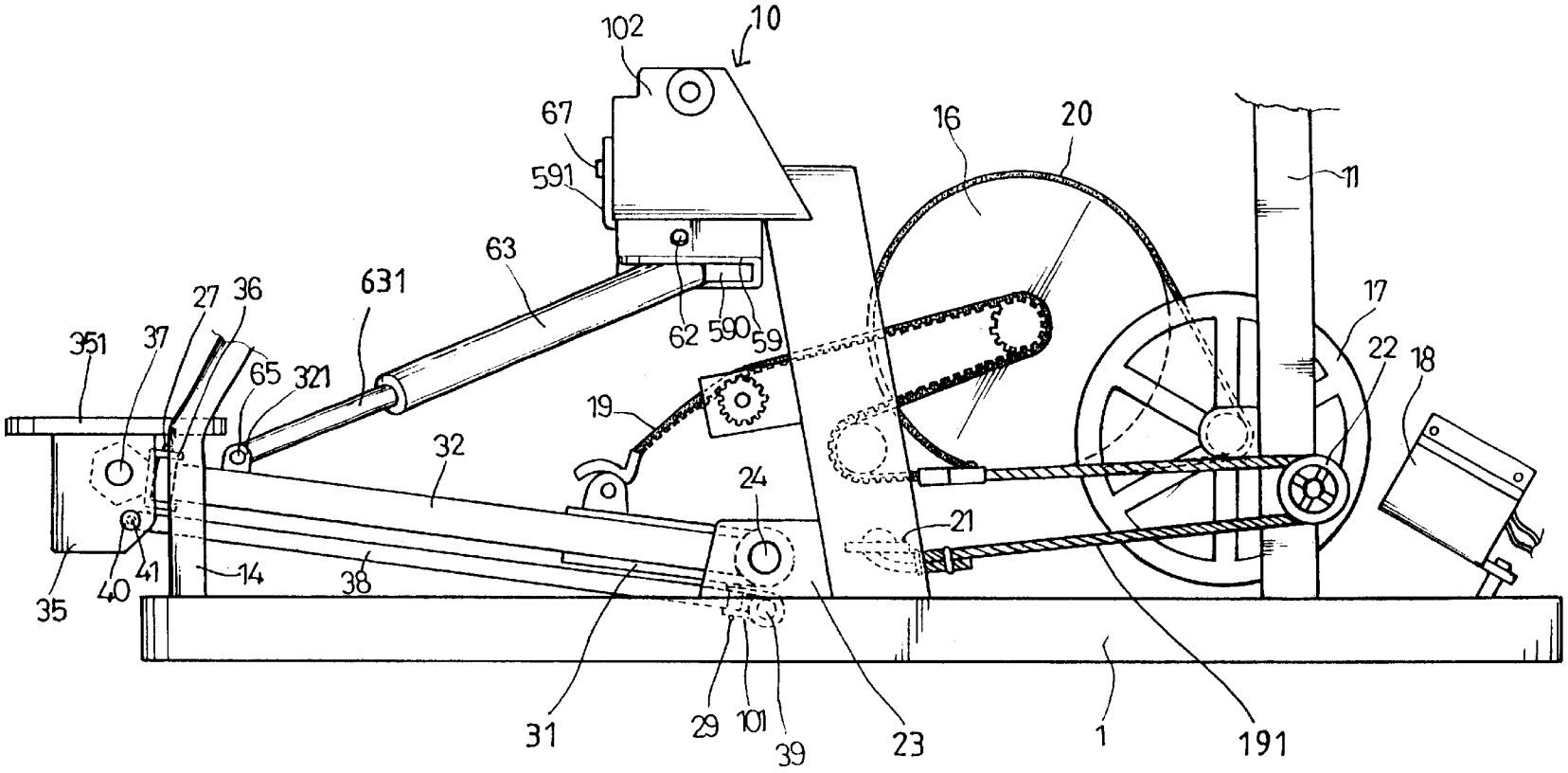
FIG. 12 is a partial side view similar to FIG. 3, illustrating the operation of the exerciser.

In operation, as shown in FIGS. 3, 4 and 12, when the foot pedals 34, 35 of the foot supports 30 are rotated or moved up and down relative to the base 1 about the shaft 24 by the users, the resilient cables 191 may be pulled by the foot supports 30, in order to rotate the pinions 164, and thus to rotate the wheels 16 and 17. The pinions 164 are rotatably secured to the pivot axle 163 with the typical unidirectional bearings (not shown), for allowing the pivot axle 163 and thus the wheels 16, 17 to be rotated and driven by the foot supports 30 via the belt 19, when the foot pedals 34, 35 are rotated or moved up and down relative to the base 1, in reciprocating action, by the users. The resilient cables 191 may pull or recover the foot supports 30 to the upward position as shown in FIGS. 3 and 4 when the foot pedals 34, 35 are released. 10 with pivot pins 66 respectively, and each includes a chamber 590 formed therein (FIGS. 3, 4, 12). The pivot pins 66 are preferably parallel to the horizontal plane surface of the base 1. The casings 59 each includes a panel 591 secured thereto and having a curved channel 592 formed therein for slidably receiving the guiding studs 67 which may guide the casings 59 to rotate relative to the base 1 about the pivot pins 66.

Figure 7:
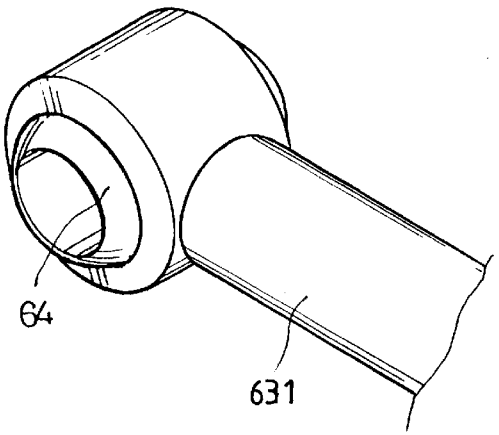
FIG. 7 is a further enlarged partial perspective view of the exerciser.
Figure 6:
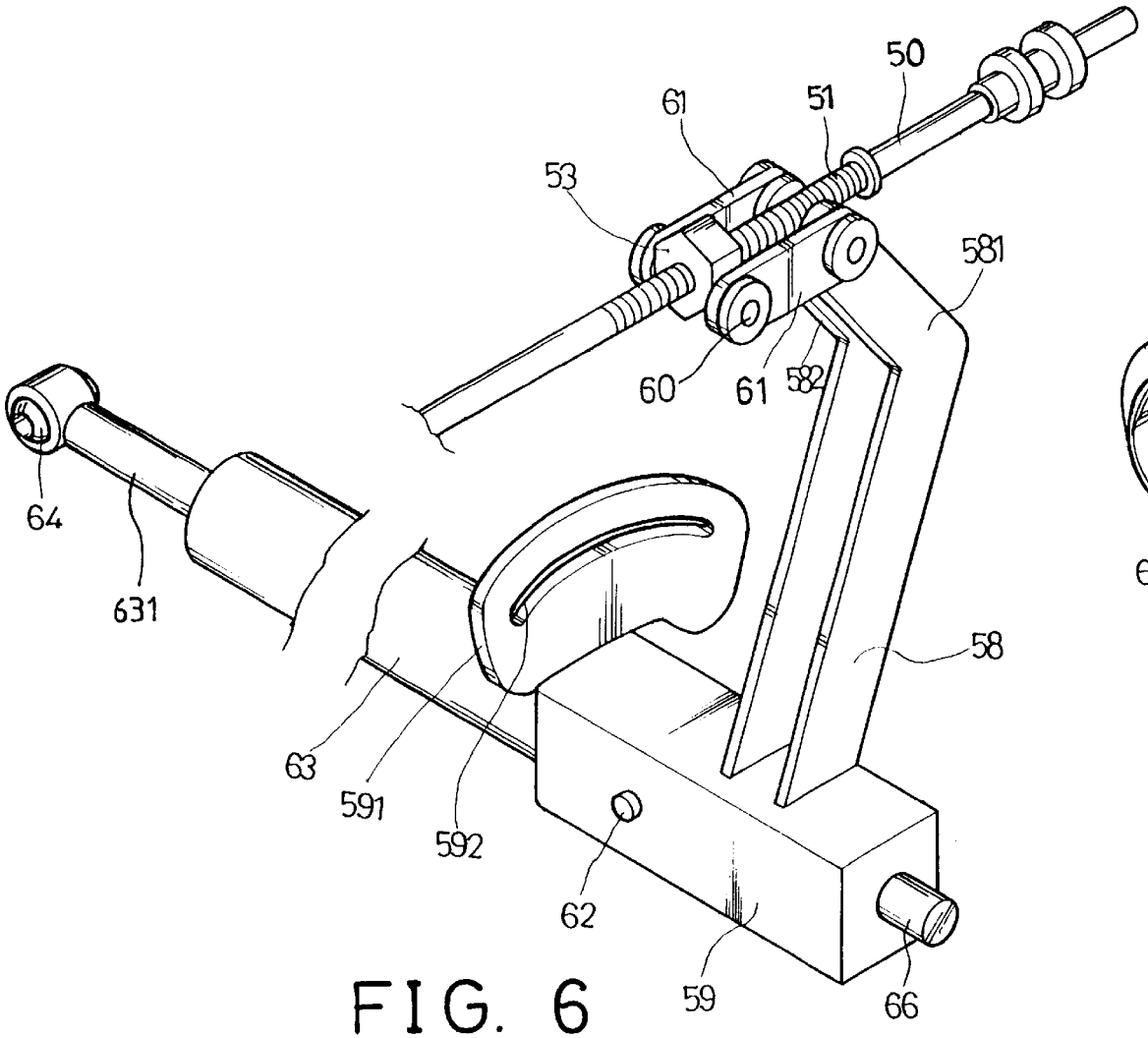
FIG. 6 is an enlarged partial perspective view of the laterally actuating device for the exerciser.

Two coupling members 63, such as the linear motion bearings, or resilient cables or wires, or the like, each includes one end rotatably or pivotally secured to the casings 59 with a pivot pin 62 respectively, a club 631 slidably engaged therein and extendible outward therefrom, and a universal joint 64 (FIGS. 6, 7) attached to the free end of the club 631 for rotatably secured to the middle or rear ears 321 of the beams 32 or of the foot supports 30 with a pivot pin 65. The coupling members 63 may thus suitably couple the foot supports 30 to the casings 59, for stably guiding the foot supports 30 to move relative to the base 1.

Figure 8:
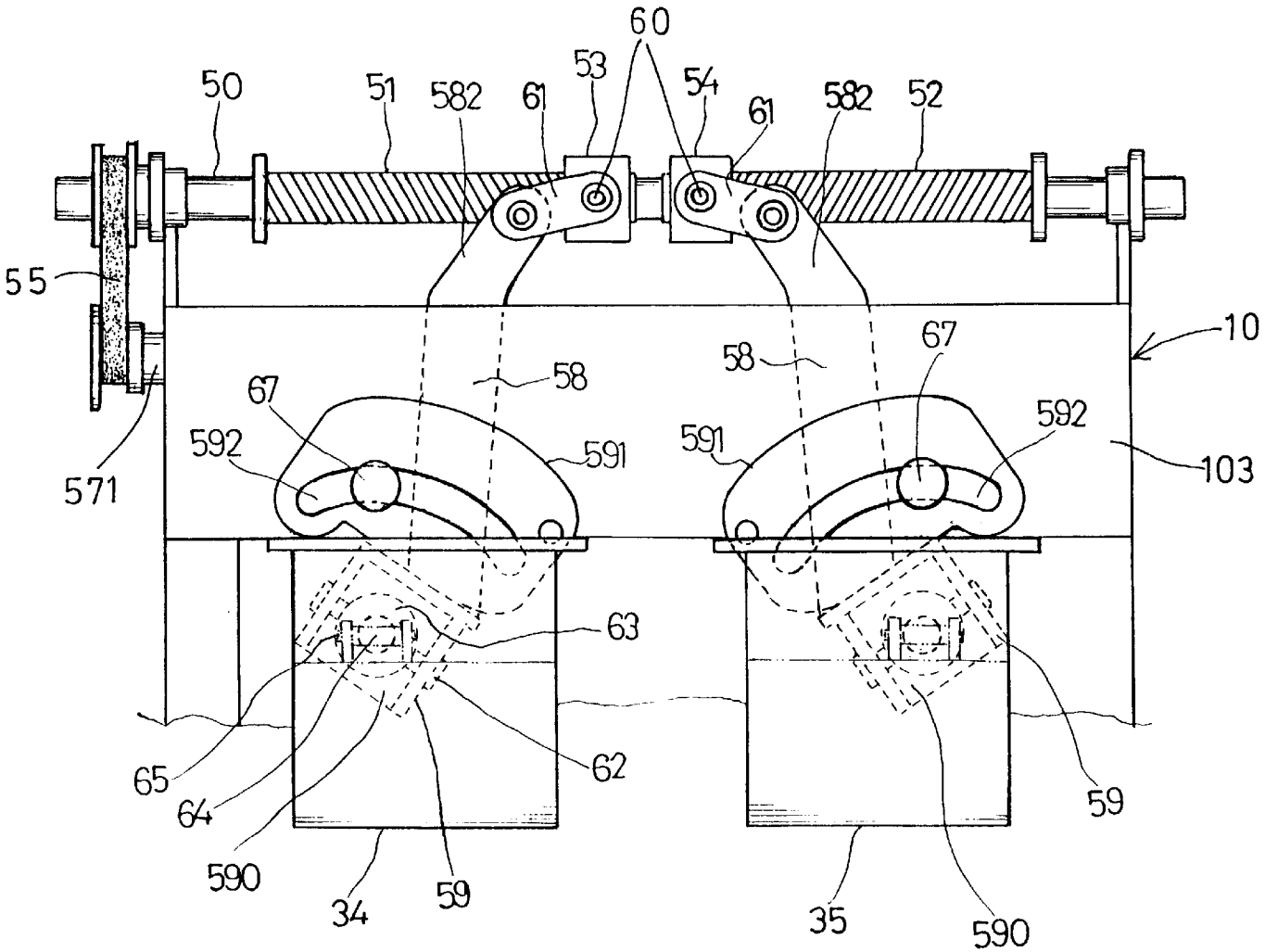
FIG. 8 is a partial rear end view of the exerciser.
Figure 9:
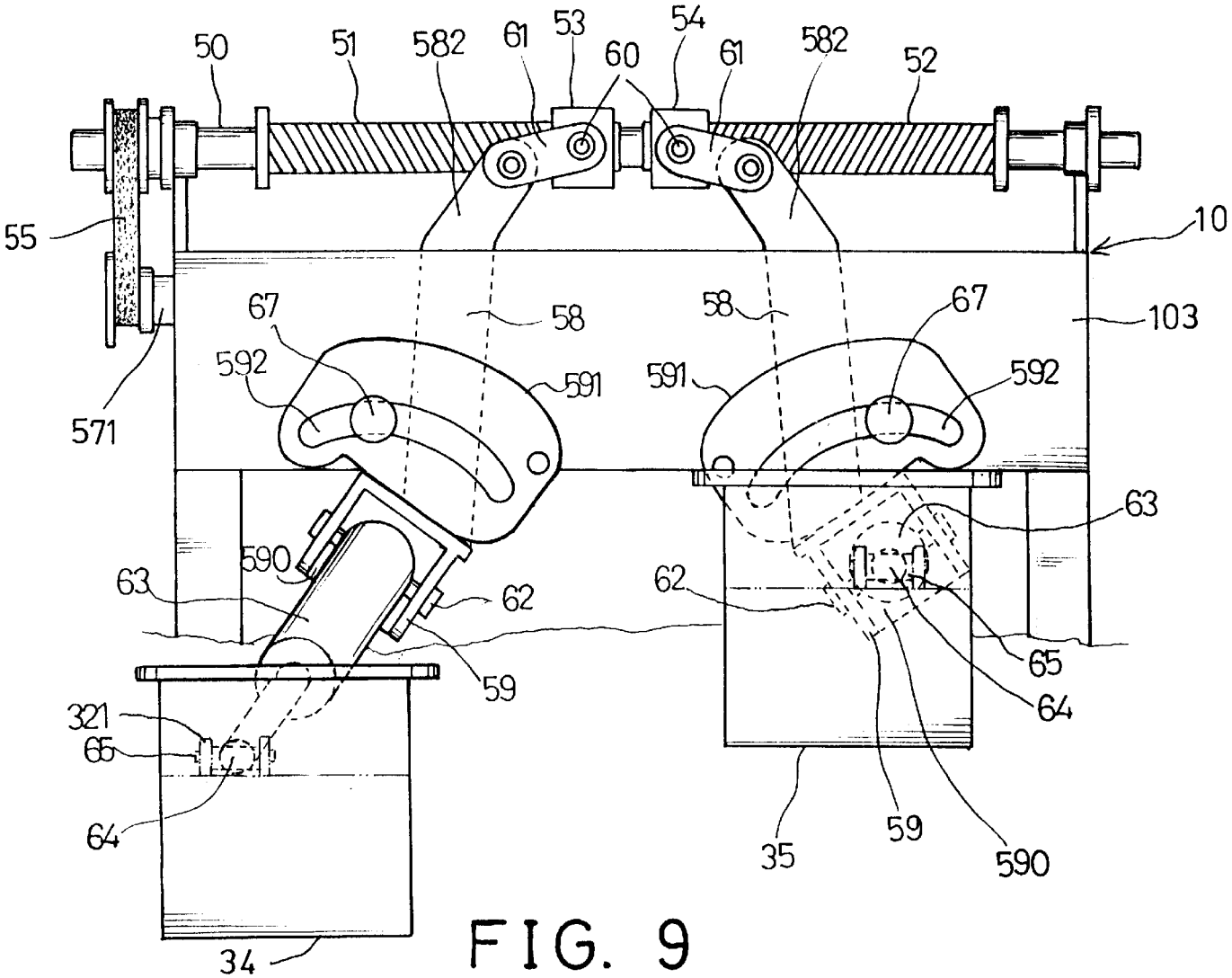
FIGS. 9, 10 are partial rear end views similar to FIG. 8, illustrating the operation of the exerciser.
Figure 10:
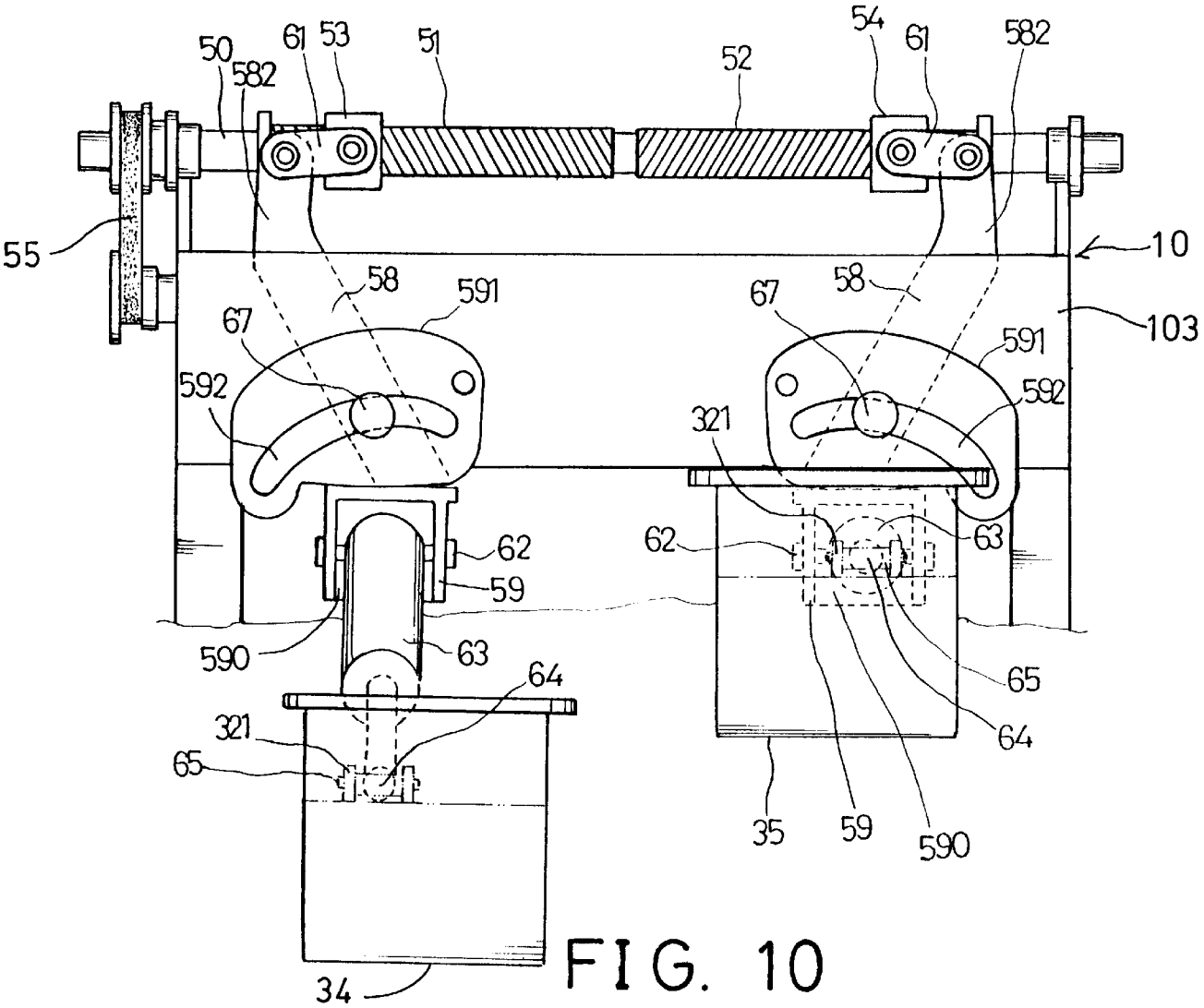
Figure 11:
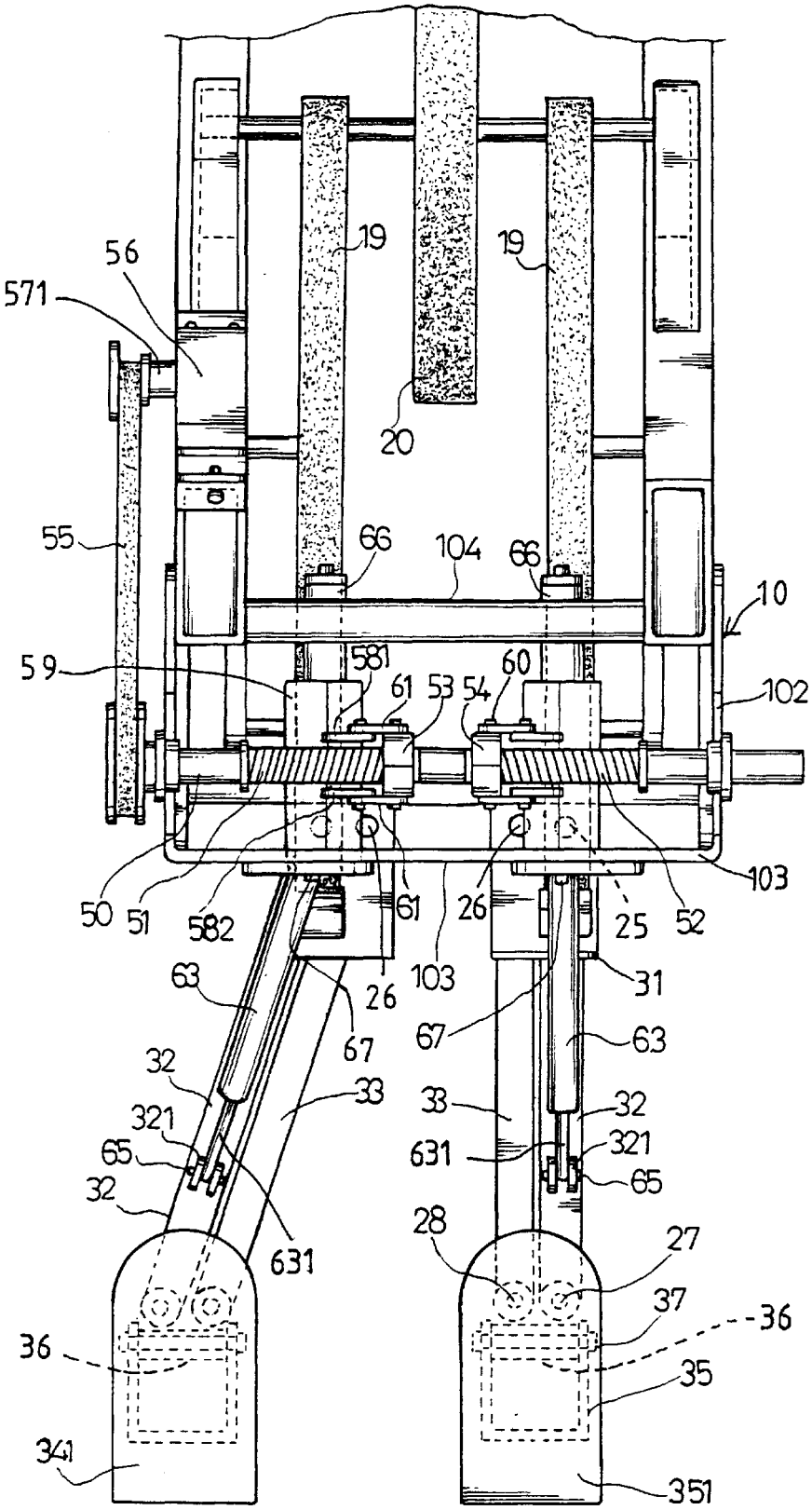
FIG. 11 is a partial top plan view similar to FIG. 5, illustrating the operation of the exerciser.

In operation, as shown in FIGS. 8–10, when the casings 59 are rotated relative to the front wall 104 of the housing 10 about the pivot pins 66 (FIGS. 5, 6, 11) respectively, the coupling members 63 may also be caused to be rotated in concert with the casings 59 and may be rotated relative to the front wall 104 of the housing 10 about the pivot pins 66, such that the foot supports 30 may also be caused to move sidewise or laterally relative to the housing 10, by the coupling members 63 and the casings 59. The sliding engagement of the studs 67 in the channels 592 of the panels 591 of the casings 59 may guide or facilitate the rotational movement of the casings 59 relative to the housing 10 about the pivot pins 66 respectively.

As shown in FIGS. 2, 5, 6, and 8–11, a pole 50 is rotatably supported or secured in the housing 10, and includes two worms or screws 51, 52 formed or provided thereon. The screws 51, 52 or the threads of the screws 51, 52 are arranged opposite to each other. Two nuts or rotary members 53, 54 are threaded to the screws 51, 52 respectively, and movable toward each other or away from each other by the screws 51, 52 when the pole 50 is rotated relative to the housing 10. A motor 57 (FIG. 2) may be secured to the housing 10 with a box 56, and includes a spindle 571 (FIGS. 5, 8–11) coupled to the pole 50 with such as a belt-and-pulley coupling mechanism 55, or the other coupling mechanisms, such as the gearing mechanism, or the sprocket-and-chain coupling mechanism (not shown), etc.

The casings 59 each includes an arm 58 extended upward therefrom (FIGS. 6, 8–10), and having an upper portion 581 rotatably or pivotally coupled to the rotary members 53, 54 with links 61 and pivot pins 60 respectively, such that the casings 59 may be caused to rotate relative to the housing 10 about the pivot pins 66 by the rotary members 53, 54 and the arms 58 when the rotary members 53, 54 are caused to move along the screws 51, 52 of the pole 50, and when the pole 50 is rotated by the motor 57 or is rotated manually.

Figure 13:
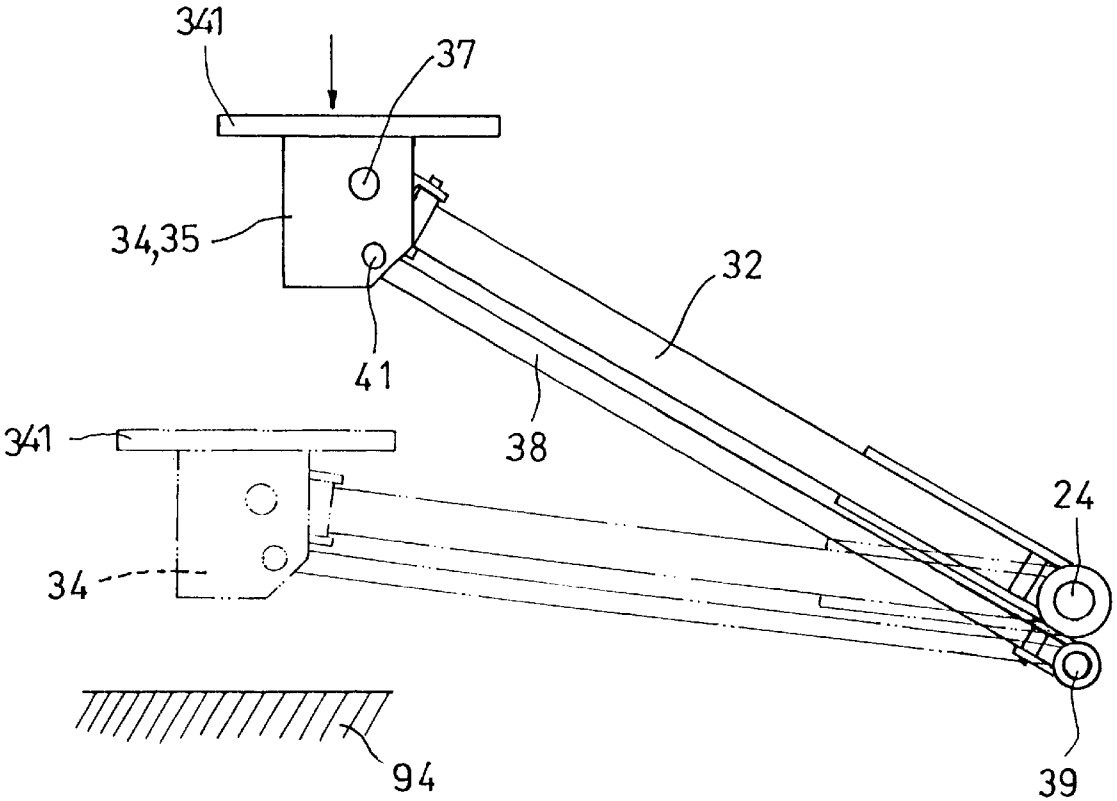
FIG. 13 is a partial side schematic view illustrating the operation of the exerciser.
Figure 14:
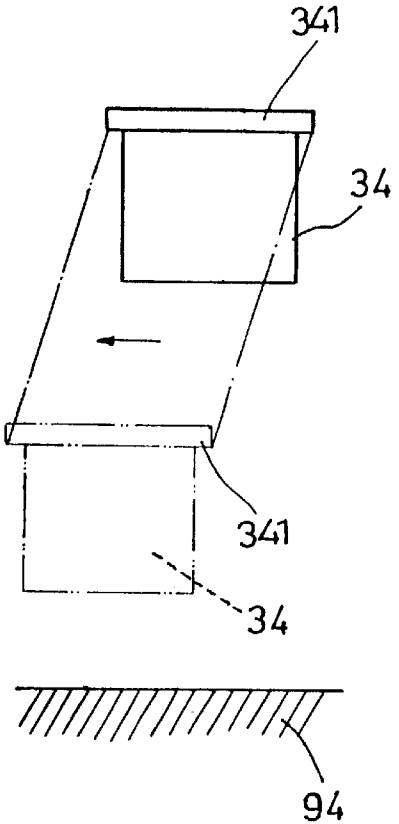
FIG. 14 is a partial rear end schematic view illustrating the operation of the exerciser.
Figure 15:
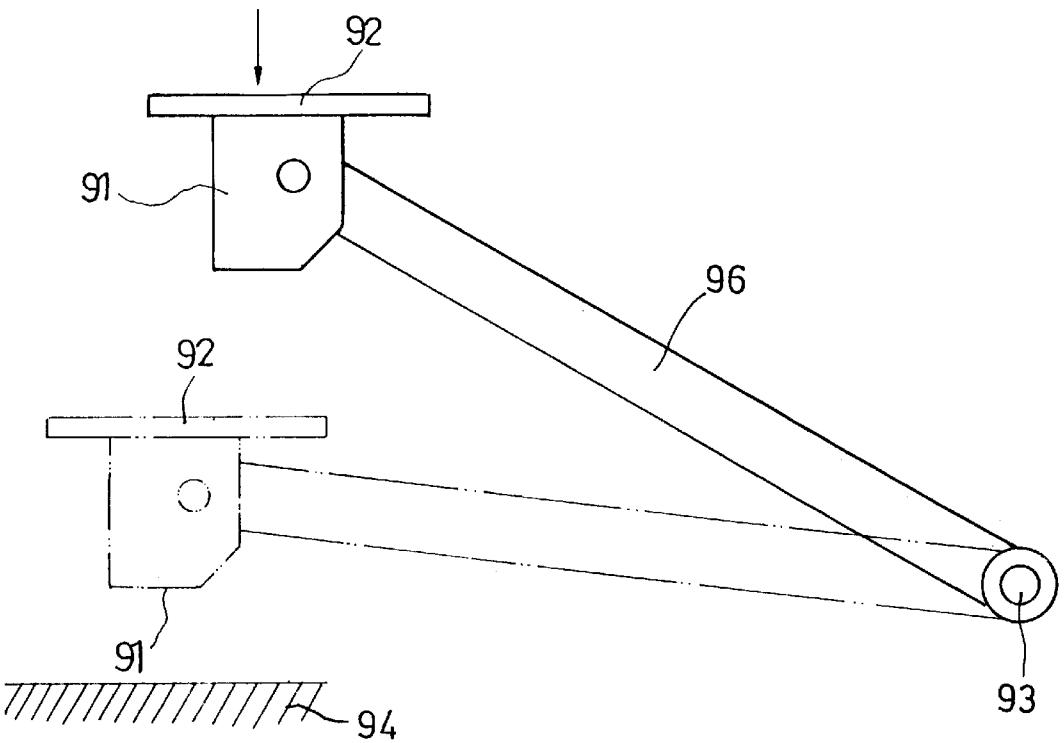
FIG. 15 PRIOR ART
FIG. 15 is a partial side schematic view illustrating the operation of a typical exerciser.
Figure 16:
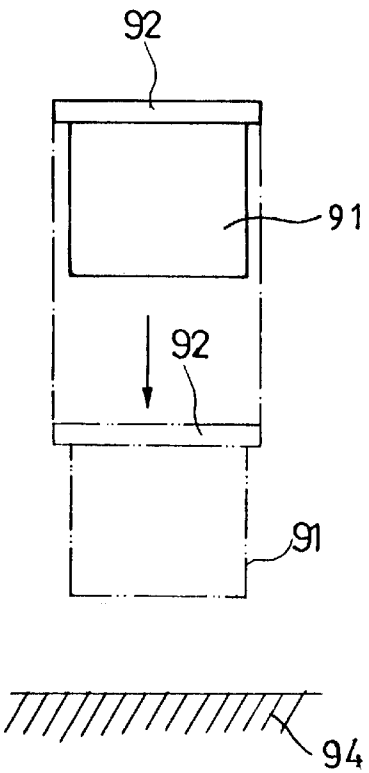
FIG. 16 PRIOR ART
FIG. 16 is a partial rear end schematic view illustrating the operation of the typical exerciser as shown in FIG. 15.

In operation, when the pole 50 is rotated relative to the housing 10, such as by the motor 57, or rotated manually, the rotary members 53, 54 may be caused to move along the pole 50 or caused to move sidewise or laterally relative to the housing 10. The casings 59 and the coupling members 63 may thus be caused to rotate relative to the housing 10 (FIGS. 8, 9), and the foot supports 30 may thus be caused to rotate and move up and down, and sidewise or laterally relative to the base 10 or the ground 94 (FIGS. 13, 14).

As shown in FIG. 10, when the casings 59 are centralized or perpendicular to the base 1 or to the ground 94, or when the chambers 590 of the casings 59 are facing downward toward the base 1, the foot supports 30 may only be moved up and down relative to the base 1, and may not be moved sidewise or laterally relative to the base 1. The foot supports 30 may be moved up and down relative to the base 1, and may simultaneously be moved sidewise or laterally relative to the base 1 when the casings 59 are rotated or inclined relative to the base 1.

The rotary members 53, 54 may be moved along the screws 51, 52 to the predetermined positions in order to rotate the casings 59 and thus the foot supports 30 relative to the base 1 at different angular positions. Or, the rotary members 53, 54 may be continuously moved along the screws 51, 52 in reciprocating action, to continuously adjust the casings 59 and thus the foot supports 30 relative to the base 1 at different or changing angular positions.

Accordingly, the exerciser includes a pair of foot supports that may be moved laterally or sidewise relative to the base.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An exerciser comprising:

a base, a pair of foot supports pivotally secured to said base with a pivot shaft, and movable up and down relative to said base about said pivot shaft for conducting stepping exercises, and means for moving said foot supports laterally relative to said base; whereby the foot supports may be moved only up and down or may be moved both up and down and laterally relative to said base.

2. The exerciser according to claim 1, wherein said moving means includes a pair of casings rotatably supported on said base, and means for coupling said casings to said foot supports.

3. The exerciser according to claim 2, wherein said coupling means includes a pair of coupling members coupled between said casings and said foot supports respectively.

4. The exerciser according to claim 2 further comprising means for rotating said casings relative to said base.

5. The exerciser according to claim 4, wherein said base includes a housing secured thereon, said rotating means includes a pole rotatably supported on said housing and having two screws, two rotary members threaded with said screws respectively, and means for connecting said rotary members to said casings, said casings are rotated relative to said base when said rotary members are moved relative to said pole and when said pole is rotated relative to said housing.

6. The exerciser according to claim 5, wherein said connecting means includes a pair of arms extended from said casings, and coupled to said rotary members with links respectively.

7. The exerciser according to claim 5 further comprising means for rotating said pole relative to said housing.

8. The exerciser according to claim 7, wherein said rotating means includes a motor secured to said housing, and coupled to said pole for driving said pole.

9. The exerciser according to claim 2, wherein said base includes a housing secured thereon, and means for guiding said casings to rotate relative to said housing.

10. The exerciser according to claim 9, wherein said housing includes a pair of studs extended therefrom, said guiding means includes a panel secured to each of said casings, said panels each includes a curved channels formed therein for slidably receiving said studs of said housing, and for guiding said casings to rotate relative to said housing.

11. The exerciser according to claim 1 further comprising means for pivotally securing said foot supports to said pivot shaft.

12. The exerciser according to claim 11, wherein said pivotally securing means includes at least two flaps secured to said pivot shaft, said foot supports each includes at least one beam having a first end pivotally secured to said at least two flaps with pivot pins, for allowing said foot supports to be rotated relative to said pivot shaft about said pivot pins.

13. The exerciser according to claim 12, wherein said foot supports each includes a coupler pivotally secured to a second end of said at least one beam, and a foot pedal pivotally secured to said coupler with a pivot rod.

14. The exerciser according to claim 13, wherein said pivotally securing means includes a pair of levers pivotally coupled between said at least two flaps and said couplers.

15. The exerciser according to claim 1 further comprising means for applying a resistive force against said foot supports.

16. The exerciser according to claim 15, wherein said resistive force applying means includes a first wheel rotatably supported on said base with a pivot axle, and means for coupling said first wheel to said foot supports.

17. The exerciser according to claim 16, wherein said coupling means includes a pinion secured to said pivot axle, a belt engaged over said pinion and having a first end secured to said foot support and having a second end, and a resilient cable coupled between said second end of said belt and said base.

18. The exerciser according to claim 17 further comprising a second wheel rotatably supported on said base, and means for connecting said second wheel to said first wheel.

19. The exerciser according to claim 18 further comprising means for braking said second wheel.

* * * * *